United States Patent [19]

Eklund

[11] 4,357,785

[45] Nov. 9, 1982

[54] TELESCOPIC MAST

[76] Inventor: Erik Eklund, Klövervägen 15, 161 36 Bromma, Sweden

[21] Appl. No.: 116,479

[22] Filed: Jan. 29, 1980

[30] Foreign Application Priority Data

Feb. 9, 1979 [SE] Sweden ..... 7901163

[51] Int. Cl.[3] ..... E04G 25/00

[52] U.S. Cl. ..... 52/632; 52/118

[58] Field of Search ..... 52/111, 115, 118, 121, 52/632

[56] References Cited

U.S. PATENT DOCUMENTS

| | | | |
|---|---|---|---|
| 2,339,327 | 1/1944 | Fox | 52/121 |
| 2,920,725 | 11/1960 | Emmons | 52/118 |
| 3,495,370 | 2/1970 | Habro | 52/118 |
| 3,624,979 | 8/1969 | Przybylski | 52/118 |
| 3,796,016 | 3/1974 | Wu | 52/118 |
| 3,802,136 | 4/1974 | Eiler | 52/118 |
| 4,062,156 | 12/1977 | Roth | 52/632 |

*Primary Examiner*—Price C. Faw, Jr.
*Assistant Examiner*—Henry E. Raduazo
*Attorney, Agent, or Firm*—Silverman, Cass & Singer

[57] ABSTRACT

Pipes for a telescopic mast have at least three guide grooves along their entire length, this is with the exception of the inner pipe having the smallest cross-sectional area which may not have guide grooves. All pipes except the pipe intended to be the outermost one in the telescopic mast have guide blocks attached to the lowermost portion of their outside. All pipes (4) except the pipe (4) intended to be the innermost one in the telescopic mast have guide blocks attached to the uppermost portion of their inside.

2 Claims, 9 Drawing Figures

TELESCOPIC MAST

This invention relates to a telescopic mast, which is formed of a plurality of nested extruded pipes, preferably of light-metal alloy and with closed cross section, and with guide means between the mutually movable pipes, which telescopic mast is intended to support an aerial, lighting fitting, radio or bearing screen.

It is known that the sectional pipes, which often have three or six substantially planar sides, are guided relative to each other in that the pipes on their inside are provided with guide grooves distributed about the inside along the entire length of the pipes, and that the pipes, with the exception of the lowermost one, are provided on their outside with guide strips along the entire length of the pipes, which strips are slidable and accurately fitted into guide grooves in order to give stability to the extended telescopic mast. This design, however, shows the disadvantages that the long guide strips are located on the outside of the telescopic mast in its extended state and easily are deformed by an external impact, so that the strips do not slide any longer in the guide grooves, not even when the guide strips are made of plastic material with a low friction coefficient, and within a relatively short time are covered with free-flying particles of various kinds, whereby also the slidability of the guide strips in the guide grooves is deteriorated.

The present invention has as an object to design a telescopic mast of sectional pipes and with guide means between the pipes, such that the original easy slidability of the pipes relative to each other is maintained, and that no guide means project into the free air.

This object is achieved by the present invention, in that the telescopic mast has been given the characterizing features defined in the attached claims.

BRIEF DESCRIPTION OF THE DRAWINGS

The invention is illustrated in the accompanying drawings by an embodiment shown by way of example, in which drawings

DESCRIPTION OF THE PREFERRED EMBODIMENT

Figure 1:
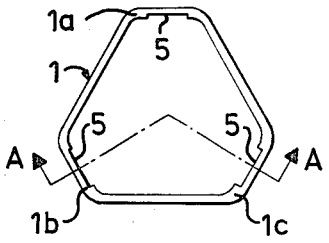
FIG. 1 is an end view of a pipe comprised in a telescopic mast according to the invention.
Figure 2:
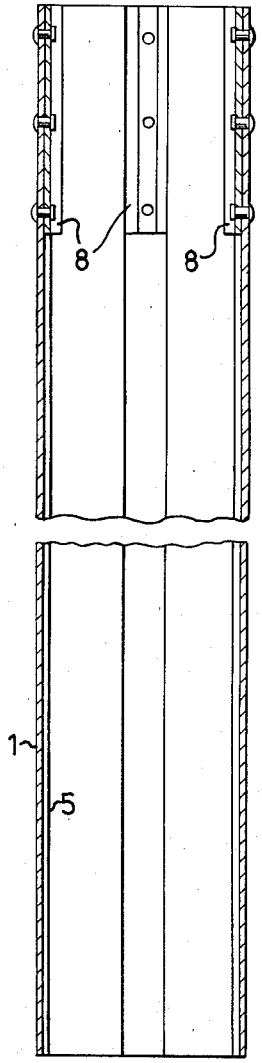
FIGS. 2–5 are longitudinal sections along the line A—A in FIG. 1 through pipes for a telescopic mast, of which a central portion is cut away.
Figure 3:
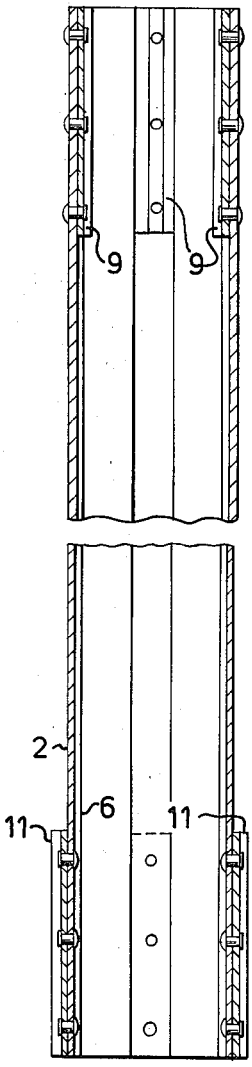
Figure 4:
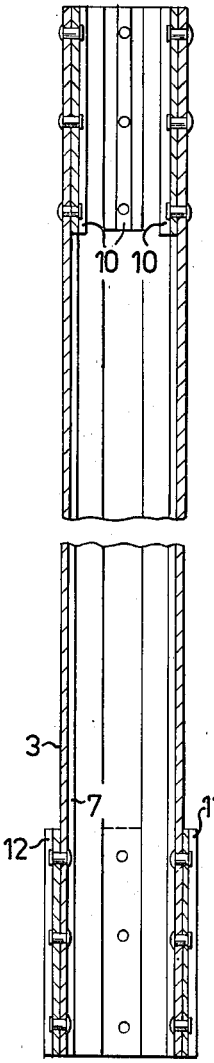
Figure 5:
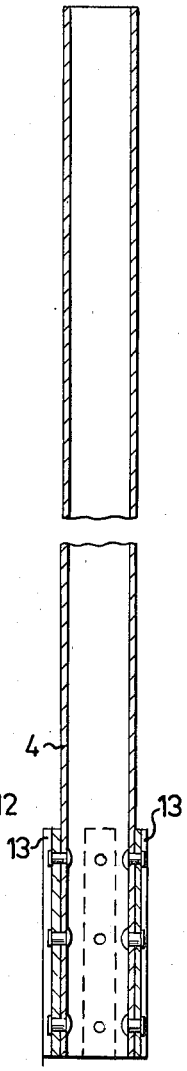

The pipe 1 shown in FIG. 1 as well as other pipes, nested for the telescopic mast are extruded light-alloy metal pipes having six substantially planar, but differently width side walls, which form a closed section. Three side walls 1*a*,1*b*,1*c* forming a 120° angle relative to each other have a slightly greater wall thickness than the remaining side walls, and each of said sides 1*a*,1*b*,1*c* is provided on their inside with straight guide grooves 5 cut in along the entire length of the pipe.

In FIGS. 2–5 the pipes 1–4 intended to form a telescopic mast are shown. The pipes 1–3 have internal guide grooves 5–7. Said lastmentioned pipes 1–3 are provided at their upper end with guide blocks 8,9,10 in the respective guide grooves 5–7, and the pipes 2–4 are provided at their lower end with guide blocks 11,12,13 on their outside for engagement with the guide grooves 5–7. When the pipes 1–4 are being positioned one into the other, the guide blocks 11–13 guide in the guide grooves 5–7, and the guide blocks 8–10 guide against the outside of the pipes 2–4.

Figure 6:
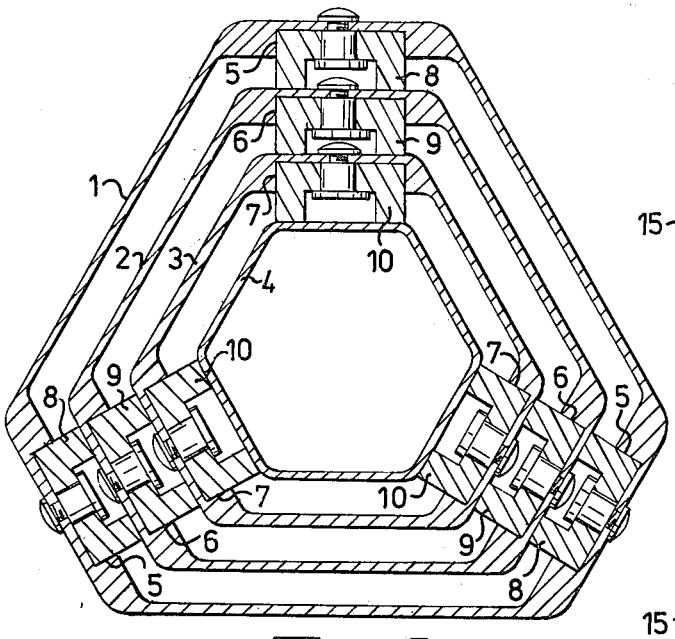
FIGS. 6,7 are cross-sections on an enlarged scale through the upper and, respectively, lower portion of a retracted telescopic mast.
Figure 7:
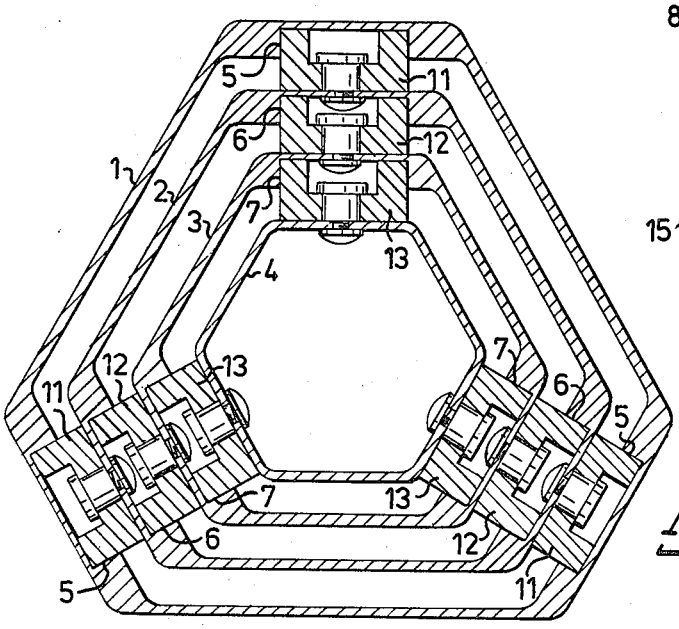

The cross-sections shown in FIGS. 6 and 7 are made upwardly and, respectively, downwardly through the telescopic mast in a retracted state of the pipes 1–4 and show more clearly how the guide blocks 8–13 guide against the respective pipe. FIG. 6, thus, shows that the guide blocks 8–10 are attached in the guide grooves 5–7 of the pipes 1–3 and are guided against the outside of the pipes 2–4. FIG. 7 shows that the guide blocks 11–13 are attached to the outside of the pipes 2–4 and are guided in the guide grooves 5–7 of the pipes 1–3. Such attachment of the guide blocks 8–13 renders it possible for the lower guide blocks 11–13 which are movable in the guide groves 5–7 to be attached with extrememly small lateral clearance in the guide grooves, because the upper guide blocks 8–10 have no lateral guidance. This is possible, because the triangular positioning of the guide blocks on the pipes yields the necessary stability to an extended telescopic mast.

All guide blocks are made of a plastic material having a high slidability, such a ROBALON, which is a high-molecular polythene material alloyed with the lubricant MOLYKOTE. This material has among other things high wear resistance, is hard, has good impact and bending strength, and has no adhesive capacity, so that loose particles do not adhere thereon.

Figure 8:
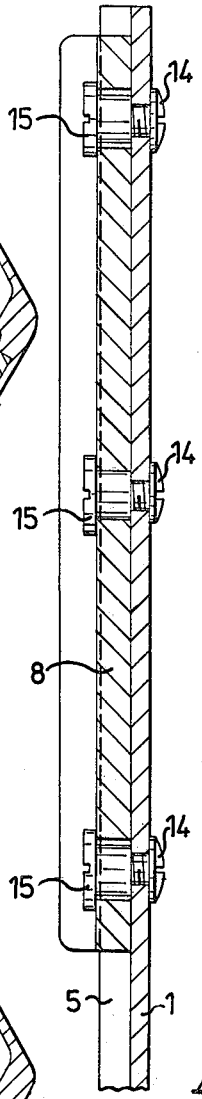
FIG. 8 is a longitudinal section on a further enlarged scale through an upper portion of a pipe wall.

FIG. 8 shows the attachment of an upper guide block 8 on a wall portion of the pipe 1. The guide block 8, which preferably has a length of about 20 cm, is connected with the pipe 1 at about the center of its length and close to its ends by means of threaded screws 14 and sleeve nuts 15. The sleeve nut 15 at the center of the guide block is attached without clearance through a hole in the guide block, and the sleeve nuts 15 at each guide block end are attached with clearance in the guide block. All guide blocks 8–13 are attached in the way described.

Figure 9:
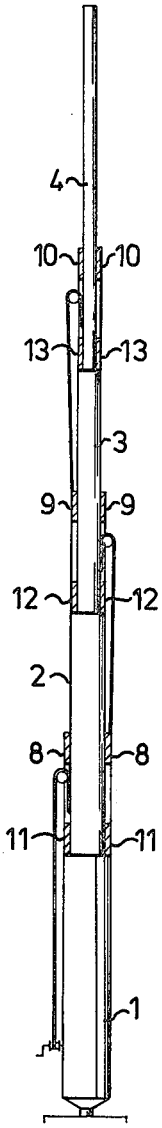
FIG. 9 shows on a smaller scale an erected telescopic mast.

FIG. 9 shows where the guide blocks 8–13 will be located when the telescopic mast is extended. The maximum extension of the pipes is determined in a usual manner by means of stop bosses (not shown) suitably placed on or in the pipes.

The telescopic mast according to the invention especially has the advantages, that the telescopic mast always can easily be extended and retracted, because the guide blocks due to their location downwardly and upwardly and, respectively, their attachment downwardly on the outside and upwardly on the inside of the same pipe cannot cause interlocking of the pipes. A further contributing factor to this is that no guide blocks have sliding surfaces directed outward to the free air and exposed to particle accumulation. Due to the fact that every guide block is locked at the center of its length to the pipe, but from there has limited axial movability, the guide block is prevented from being deformed and being jammed against an adjacent pipe when temperature variations give rise to different linear expansion of the guide block and the pipe carrying the same.

The pipes to form the telescopic mast can be assembled preferably at the place of manufacture and can be transported in a retracted state to the place of erection. There the pipes can be extended and in a usual manner by means of split pins or the like be locked axially, whereafter stay wires are attached in suitable holders on the telescopic mast and the mast easily can be erected, because its weight is relatively low. The telescopic mast alternatively can be provided in a usual way with a hoisting means, by which the pipes are hoisted into vertical position, and the telescopic mast is anchored by means of stay wires.

The invention must not be regarded restricted only to the embodiment shown and described, because this can be varied within the scope defined by the claims. The number of pipes, for example, and their mutual and total length can be varied. The inner pipe forming the mast top may have the same as or a different cross-sectional shape than the other pipes. The pipes may be circular or have more than six sides, and then also more than three guide grooves, and guide blocks corresponding thereto. The pipes may be made of a relatively light material other than light-alloy metal.

I claim:

1. A telescopic mast comprising:

a plurality of extruded pipes nested and spaced from one another and movable relative to one another, each pipe having a closed cross section and having planar side walls, the pipes being arranged with their planar side walls substantially parallel one another, and each pipe having at least three guide grooves in the interior of its side walls extending along the entire length of the pipe; and guide means attached to the pipes for maintaining the spacing of the pipes one from another and serving as bearing members during movement of the members relative to one another, the guide means further for maintaining the rotational stability of the pipes during relative movement, the guide means being in the form of a plurality of guide blocks provided at the upper and lower ends of the pipes, the guide blocks located at the upper ends of the pipes being fixedly mounted within the grooves and projection therefrom into sliding engagement against the exterior of the planar side walls of the pipes located inside thereof, and the guide blocks located at the lower ends of the pipes being attached on the exteriors of the planar side walls of the pipes for limited movement and projecting therefrom into slidable engagement in the grooves of the pipes located outside thereof.

2. The telescopic mast as claimed in claim 1 in which the lower guide blocks are elongate and are attached to the pipes through fastener means engaged through each block at both the center thereof and toward the opposed ends thereof, the lower guide blocks each including a center hole defined therethrough, said center hole being of a size to closely receive the associated fastener means, each lower guide block further having end holes defined therethrough and of a size to receive the associated fastener means and provide limited clearance thereabout to allow for limited movement at the opposed ends of the lower guide blocks.

* * * * *